United States Patent [19]

Cooke

[11] 3,952,899

[45] Apr. 27, 1976

[54] SAFETY CLOSURE CAP

[75] Inventor: Carl W. Cooke, Los Angeles, Calif.

[73] Assignee: CWC Industries, Los Angeles, Calif.

[22] Filed: Nov. 8, 1974

[21] Appl. No.: 522,018

Related U.S. Application Data

[63] Continuation-in-part of Ser. No. 479,044, June 13, 1974, Pat. No. 3,888,376.

[52] U.S. Cl. ..... 215/217

[51] Int. Cl.[2] ..... B65D 85/56; B65D 55/02; A61J 1/00

[58] Field of Search ..... 215/9, 217, 218, 219

[56] References Cited

UNITED STATES PATENTS 2,776,066 1/1957 Thornton ..... 215/217

3,741,421 6/1973 Wittwer ..... 215/217

*Primary Examiner*—George T. Hall

*Attorney, Agent, or Firm*—Fulwider Patton Rieber Lee & Utecht

[57] ABSTRACT

A single piece, threaded safety closure cap for sealing the open end of a container. The closure thread is continuous and a locking shoulder is integrally formed along the upper surface of the thread for engagement with a corresponding locking shoulder disposed on the lower face of the container thread when the closure is in sealing position on the open end of the container to prevent removal of the closure by simple reverse rotation.

6 Claims, 12 Drawing Figures

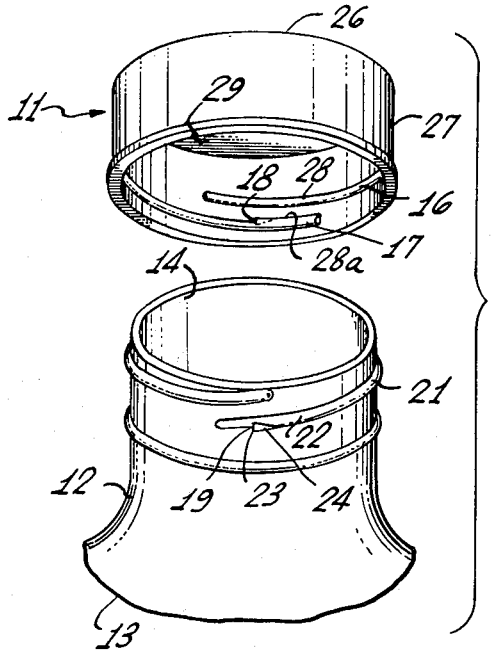
Fig. 1
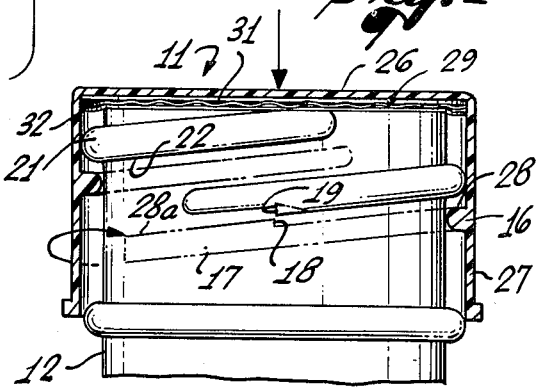
Fig. 4
Fig. 2
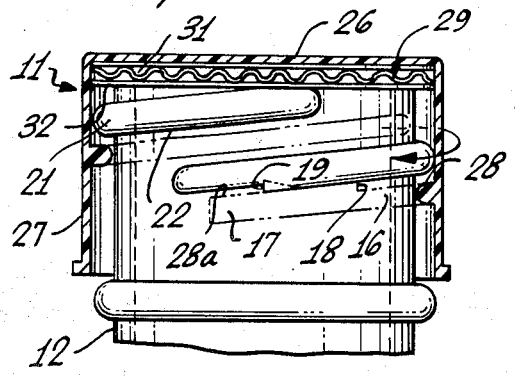
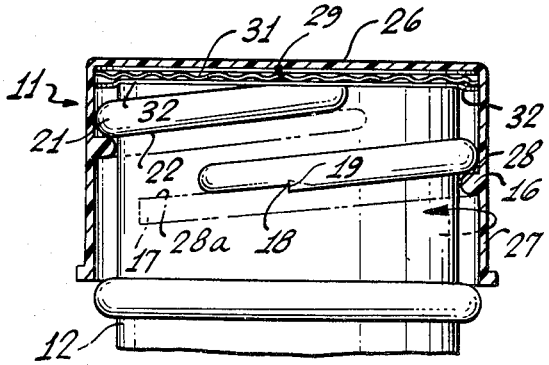
Fig. 3

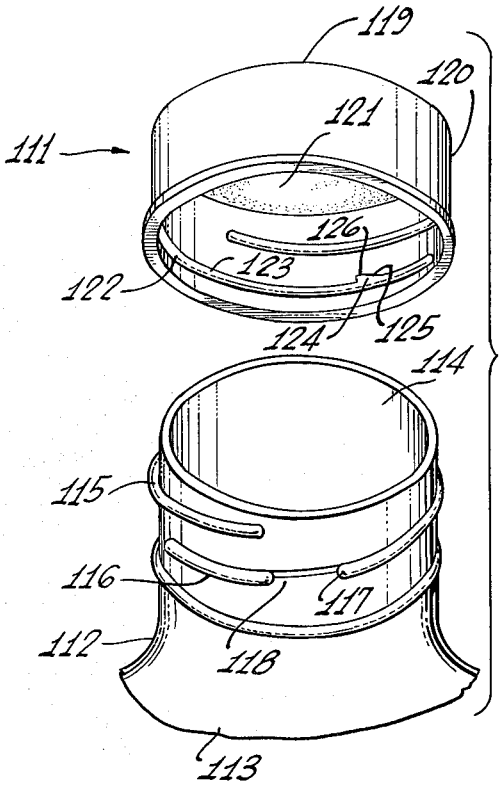
Fig. 5
Fig. 6
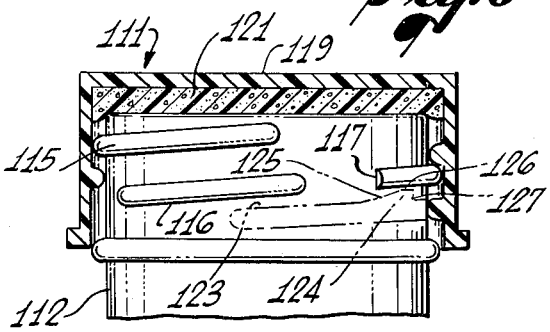
Fig. 7
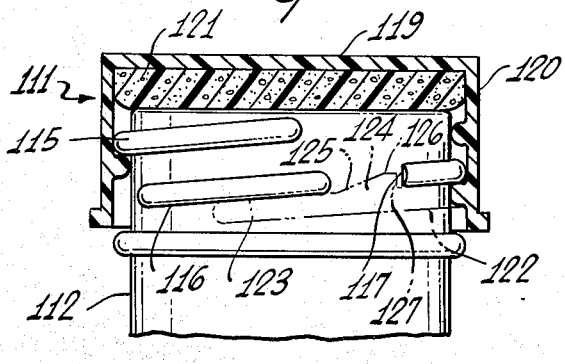
Fig. 8
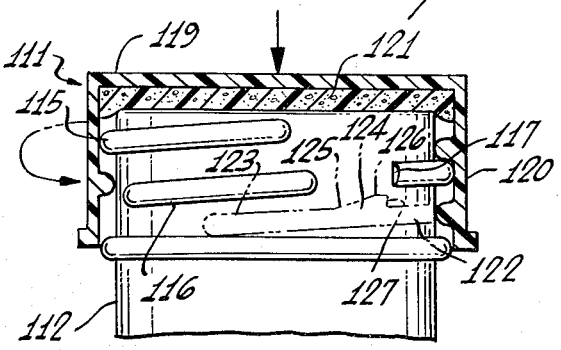

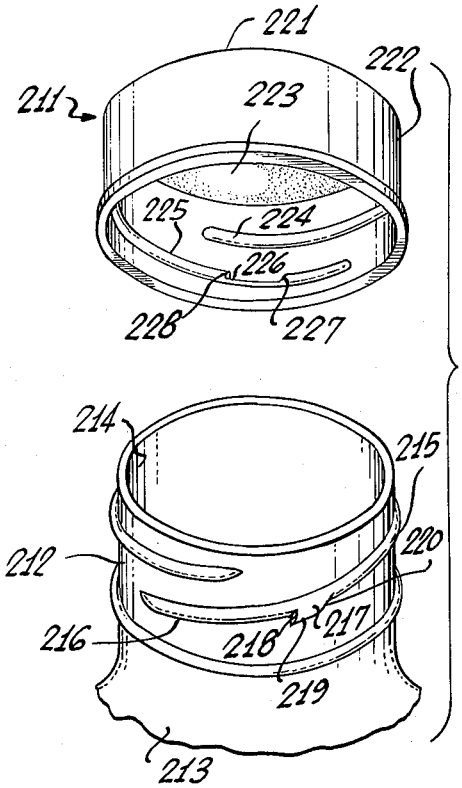
Fig. 9
Fig. 10
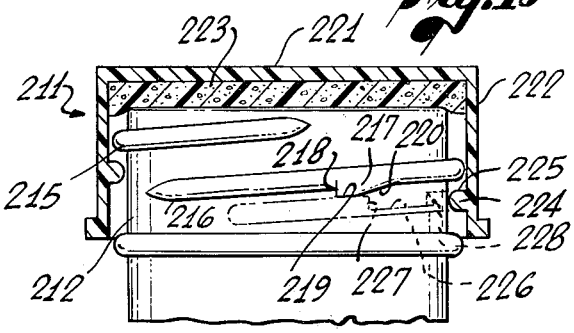
Fig. 11
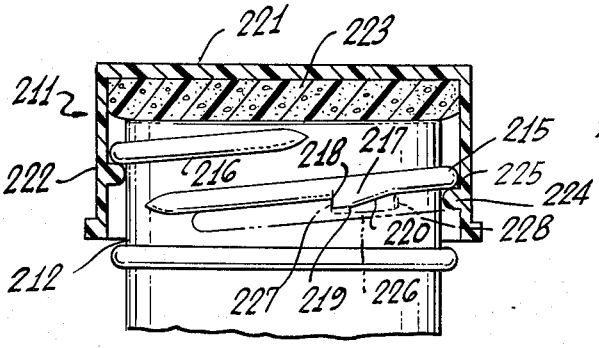
Fig. 12
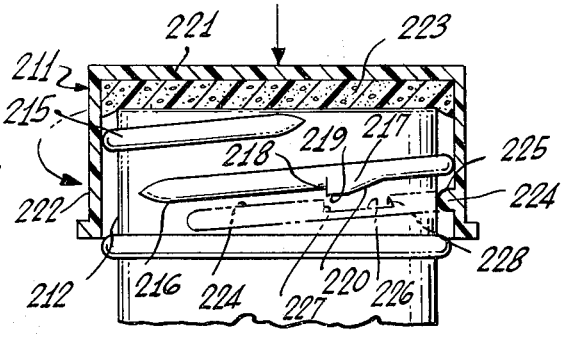

SAFETY CLOSURE CAP

CROSS-REFERENCE TO RELATED APPLICATIONS

This application is a continuation-in-part of application Ser. No. 479,044, filed June 13, 1974; now U.S. Pat. No. 3,888,376 granted June 10, 1975.

BACKGROUND OF THE INVENTION

This invention relates to closures for containers and more particularly to the so-called "safety" closures which, once drawn into sealing engagement with the container, can be removed only by a special manipulative procedure which is beyond the capabilities of most infants and small children.

Various safety closures have been suggested by the prior art which are designed to make the removal of the closure much more difficult than in the case of conventional closures. Such safety closures are primarily used on containers which are designed to be "child-proof". Such closures require special manipulative techniques which are normally beyond the comprehension or physical ability of a child so that removal of the closure by children is extremely difficult and the danger of a child removing the closure and consuming the contents of the container is substantially reduced.

Such closures can be generally described as including a resilient sealing member which is compressed when the closure is drawn into the sealing position, a depending skirt portion adapted to fit over the neck of the container and which is adapted on the inner surface thereof, usually by threads, for engagement with the container to maintain the closure in sealing position on the container. In addition, the depending skirt portion normally carries one or more separate projections or lugs which are adapted to interengage with cooperating indentations or projections on the container for interlocking to prevent removal of the closure. These are maintained in their interlocking relationship by the upward urging of the resilient sealing member acting against the open end of the container, which sealing member is compressed when the closure is drawn into sealing relationship on the container. The closures are designed to be removed by downward pressure on the closure top which allows the closure to move downwardly resulting in a disengagement or unlocking of the corresponding projections or lugs or the closure from the indentations or projections on the container so that the closure can be removed in the conventional manner.

A significant problem encountered with the prior art safety closures is found in connection with the provision of separate projections or lugs on the closure particularly where the closure and container are threaded. Such projections or lugs, when engaged with corresponding means on the container are often of insufficient strength to withstand the shearing forces which may be encountered in an attempt to remove the closure from the container when it is in the locked position on the container and the closure is not properly manipulated to remove it in the proper manner. Thus, the projections or lugs may often be easily sheared resulting in elimination of the safety lock feature. Also, in many prior art designs, it is necessary that the lug or projection on the closure be of a resilient material so that the closure can be urged into its locked position. Such designs are unsuitable for use with metal, glass, rigid plastic and the like materials which are often desirable for use as a closure composition. Many of the designs incorporated in the prior art safety closures are such as to inhibit the sealing function of the closure so that a true fluid tight seal between the closure and the container is often not obtained.

SUMMARY OF THE INVENTION

The present invention resides in a single piece safety closure which provides a reliable, fluid tight seal for a container. The design of the closure of the present invention lends itself to conventional injection molding procedures without the necessity of special manufacturing steps which would unnecessarily raise the cost of producing the closure.

More particularly, the closure of the present invention includes a depending skirt portion provided with a thread on the open ended neck of a container for axially drawing the closure into fluid tight sealing engagement with open end. Locking means are integrally formed as part of the thread of the closure of the present invention and the locking means are adapted to cooperate with corresponding locking means provided on the thread of the neck of the container to engage therewith and prevent the removal of the closure by simply rotating the closure in an opposite direction. The closure is removed by application of sufficient force on the top portion thereof to move the closure downwardly with respect to the neck of the container thereby releasing the cooperating locking means and allowing the closure to be rotatably removed from the container neck.

In accordance with the present invention, the locking means are integrally formed on the thread of the closure, preferably as an extension or enlarged portion thereof, so as to define a shoulder along the upper surface of the closure thread which is designed to engage with a corresponding shoulder on the container thread for locking the closure on the container in the manner described hereinafter. In another embodiment of the present invention, the shoulder which is integrally formed along the upper surface of the closure thread is provided by a cut out portion disposed along the upper surface of the closure thread, which cut out portion is adapted to receive a corresponding shoulder formed by a projection disposed along the lower portion of the container thread.

In accordance with the present invention the problem of shearing the locking means on the closure is substantially eliminated since the locking means is a integrally formed as part of the closure thread. Likewise, the locking means of the present invention detracts in no way from the ability of the closure to form a fluid tight seal with the container.

Other aspects and advantages of the invention will become apparent from the following detailed description, taken in conjunction with the accompanying drawings.

BRIEF DESCRIPTION OF THE DRAWINGS

FIG. 1 is an isometric view of a closure showing a portion of the interior thereof and the neck of a container, with the remaining porition of the container broken away for compactness of illustration, illustrating locking means integrally formed as part of the closure thread in accordance with the present invention;

FIG. 2 is a side view, partially in section and partially broken away for compactness of illustration, illustrating the closure of the present invention as it is drawn into sealing engagement with the open end of the neck of the container;

FIG. 3 is a side view, partially in section and partially broken away for compactness of illustration, showing the closure of the present invention in the sealing portion on the neck of the container and with the locking means in engagement;

FIG. 4 is a side view, partially in section and partially broken away for compactness of illustration, illustrating the the closure of the present invention in the downward unlocked position prior to removal of the closure from the neck of the container;

FIG. 5 is an isometric view of a closure showing a portion of the interior thereof and the neck of a container, with the remaining portion of the container broken away for compactness of illustration, showing locking means formed in accordance with another embodiment of the present invention;

FIGS. 6, 7, and 8 are enlarged side views, partly in section and partly broken away for compactness of illustration, illustrating the use of the closure and container of FIG. 5;

FIG. 9 is an isometric view of a portion of a container and of a closure constructed in accordance with yet another embodiment of this invention; and FIGS. 10, 11 and 12 are enlarged side views, partially in section, illustrating the use of the closure and container of FIG. 9.

DETAILED DESCRIPTION OF THE INVENTION

As shown in FIGS. 1–4, the invention is embodied in a safety closure, shown generally as 11, adapted to be threadedly engaged with a neck portion 12 of a container 13 and for being axially drawn into sealing engagement with an open end 14 of the neck portion 12. The closure 11 includes a continuous thread 16 which is formed with an enlarged start end portion 17 and a shoulder 18 which is adapted to engage with a cooperating shoulder 19 carried by a thread 21 provided about the neck 12 of the container 13.

As is more specifically illustrated in FIG. 1, there is shown a part of the container 13 including the cylindrical neck 12 and the open end 14 thereof. The thread 21 provided around the exterior surface of the neck 12 defines a lower face 22 on which is provided a lug 23 defining a comming surface 24 which terminates at the shoulder 19.

The closure 11 comprises a top 26 and a cylindrical depending skirt 27 adapted to be received over the cylindrical neck 12 of the container 13. The interior surface of the top 26 is provided with a resilient sealing member 29 comprising a layer 31 of resilient compressible, elastomeric material such as for example foamed polyurethane, neoprene rubber or the like having a fluid impervious, flexible outer layer 32 adapted to fit around the open end 14 to form a fluid-tight seal therewith when the closure 11 is drawn into the sealing position.

The closure thread 16 is carried about the interior surface of the depending skirt 27 of the closure 11 and forms one or more helical turns thereabout. The thread 16 extends radially inwardly from the skirt 27 to define the upper face 28. The start end portion 17 is integral with and forms a part of the thread 16. The start end portion 17 is enlarged with respect to the remaining portion of the thread in a direction normal to the longitudinal axis of the thread so that the upper face **28*a* of the start end portion beginning at the start of the thread is contained in a plane disposed above the plane of the upper face 28 of the remaining portion of the thread. The shoulder 18 is formed at the juncture of the start end portion 17 and the remaining portion of the thread 16 and extends between the upper faces 28 and 28*a***.

The enlarged start end portion 17, by its unique design, facilitates the manufacture of the closure by injection molding techniques. Thus, in accordance with standard injection molding techniques, the closure is formed by injection of thermoplastic material into a cavity defined between an outer mold portion and a mold core. The mold core includes an axial groove which corresponds to the thread 16, including an enlarged portion corresponding to the start end portion 17, to the mold cavity for the thread. In accordance with the design of the thread 16, the mold core is readily removed from the closure 11 by simply rotating the mold core with respect to the closure allowing the thread to cooperate with the axial groove to urge the mold core out of the interior of the closure. Such a removal operation is not practicable when the closure includes separate lugs or projections as in conventional safety closures.

The operation of the closure of the present invention is most specifically illustrated in FIGS. 2–4. In the drawings, the closure 11 is illustrated as being drawn into sealing engagement (FIG. 2), as in sealing engagement and the threads interlocked (FIG. 3) and in sealing engagement with a downward force being applied to disengage the threads prior to removal of the closure (FIG. 4).

Referring more specifically to FIG. 2, the closure 11 is drawn into sealing engagement with the open end 14 by the camming action between the lower face 22 of the neck thread 21 and the upper face **28*a* of the enlarged start end portion 17 of the closure thread 16 responsive to the rotation of the closure in a clockwise direction. As the closure 11 is drawn downwardly on the neck 12, the resilient sealing member 29 is placed under compression. As shown in FIG. 3, the resilient sealing member 29, particularly the flexible outer layer 32, is deformed about the edge of the open end 14 to form a fluid-tight seal thereabout. The enlarged start end portion 17 and shoulder 18 of the closure thread 16 is moved past the shoulder 19 on the lower face 22 of the neck thread 21 and, due to the upward urging of the compressed resilient sealing member 29, the closure 11 moves longitudinally on the neck 12 until the upper face 28 of the remaining portion of the closure thread contacts the lower face of the neck thread. The shoulder 18 is cooperatively engaged with the shoulder 19 to prevent removal of the closure 11 by reverse rotation alone. As illustrated, the resilient sealing member 29 remains sufficiently compressed and defomed to continue to provide a fluid-tight seal about the open end 14 of the neck 12**.

As is more specifically illustrated in FIG. 4, the closure 11 is removed by applying a downward force against the top 26 compressing the resilient sealing member 29 and moving the closure 11 axially downwardly on the neck 12. The lower face 22 of the neck thread 21 and the upper face 28 and **28*a* of the closure thread 16 are moved apart so that the upper face 28*a* of the start end portion 17 clears the shoulder 19 and the closure can be rotated in the opposite direction. It should be clear that the downward pressure need not be continuously maintained on the cap but need only be applied while the cap is rotated sufficiently to misalign the shoulders 18 and 19**.

It should be evident that the particular manner in which the shoulder 19 is formed on the lower face 22 on the neck thread 21 is not critical. As illustrated in FIG. 1, a portion of the lower face 22 of the neck thread 21 is inclined downwardly to define the camming surface 24 and the shoulder 19. In another embodiment, as illustrated in FIG. 2, an end portion of the neck thread 21 is reduced in size as compared to the remaining portion of the neck thread to define shoulder 19.

As shown in FIGS. 5–8 there is shown a safety closure 111 adapted to be threadably engaged with a neck portion 112 of a container 113 end for being axially drawn into sealing engagement with an open end 114 of the neck portion. A thread 115 forms one or more helical turns about the exterior surface of the neck portion 113 and is raised radially outwardly from the surface of the neck portion so as to define a bead having a lower face 116. A shoulder 117 is formed by a cut out portion 118 provided along the lower face 116 as in FIG. 5. The cut out portion 118 may also be formed by removing an entire section of the thread 115 as in FIGS. 6–8.

The closure 111 comprises a top 119 and a cylindrical depending skirt 120 adapted to be received over the neck portion 112 of the container 113. The interior surface of the top 119 is provided with a resilient sealing member 121. A closure thread 122 is carried about the interior surface of the depending skirt 120 and forms one or more helical turns thereabout. The closure thread 122 is raised radially inwardly from the inner surface of the skirt 120 to define a bead having an upper face 123. An upwardly extending projection 124 is disposed on the upper face 123 of the closure thread 122 and is formed integrally as a part thereof. One side of the projection 124 defines a camming surface 125 disposed toward the start end of the closure thread 122, an upper surface 126 and a substantially perpendicular shoulder 127 oppositely disposed on the opposite side of the projection for engagement with the shoulder 117 of the container thread 115 when the closure 111 is drawn into sealing engagement on the container 113. The shoulders 117 and 127 are located along their respective threads so that they are aligned and in substantial abutment when the closure 111 is sealingly positioned on the container 113.

As more specifically shown in FIGS. 6 through 8, the closure 111 is operated substantially in the same manner as illustrated FIGS. 2–4. Thus, as shown in FIG. 6, the closure 111 is drawn into sealing engagement with the open 114 of the container 113 by the camming action between the lower face 116 of the container thread 115 and the upper surface 126 of the projection 124 on the closure thread 122. The camming surface 125 of the projection 124 aids in starting the closure thread 122 onto the container thread 115. As the closure 111 is drawn downwardly on the neck 112 the resilient sealing member 121 is placed under compression.

When the shoulder 127 of the closure thread 122 is aligned with the shoulder 117 of the container thread 115, the closure 111 moves axially upwardly due to the upward urging of the compressed sealing member 121 until the upper face 123 of the closure thread is in contact with the lower face 116 of the container thread. The projection 124 of the closure thread 122 extends into the cut away portion 118 of the container thread 115 and the shoulders 117 and 127 are cooperatively engaged to prevent removal of the closure 111 by reverse rotation alone. The resilient sealing member 121 remains sufficiently compressed and deformed to provide a fluid tight seal about the open end 114 of the container 113.

As is more specifically illustrated in FIG. 8, the closure 111 is removed by applying a downward force against the top 119 compressing the resilient sealing member 121 and moving the closure axially downwardly on the neck 112. In this manner the shoulders 117 and 127 are disengaged and the closure 111 can be rotated in the opposite direction for removal.

It should be noted that the design of the container thread illustrated in FIGS. 1–8 is additionally suited for use with a conventional threaded closure where it is unnecessary or undesirable to provide the safety feature discussed above. Thus, a container can be utilized in combination with a closure in accordance with the present invention as a safety container or in combination with the conventionally threaded closure, as an ordinary container. In this manner it is necessary only to stock conventional threaded closures and closures designed in accordance with the present invention while stocking only a single type of container.

In FIGS. 9–12 there is shown a closure 211 and a cylindrical neck portion 212 of a container 213 provided with a normally open end 214. The neck portion 212 of the container is further provided with a thread 215 which is extended radially outwardly from the neck to define a bead having a lower face 216. Disposed on the thread 215 and extending downwardly from the lower face 216 thereof is a projection 217 which defines a shoulder 218 and upper surface 219 and a camming surface 220.

The closure 211 comprises a top 221 and a cylindrical depending skirt 222 adapted to be received over the neck 212 of the container 213. The interior surface of the top 221 is provided with a resilient sealing member 223 which functions in the manner already described. The inner surface of the depending skirt 222 is provided with a thread 224 which forms one or more helical turns about the skirt. The thread is radially inwardly raised from the inner surface of the skirt 222 and defines a bead having an upper face 225. A portion of the upper face 225 is indented at 226 to define a forward locking shoulder 227 and a rear face 228. The indentation 226 extends through only a portion of the thread 224 so as to substantially maintain the integral strength of the thread and shoulder 227. The locking shoulder 227 and the rear face 228 are spaced apart so as to receive the projection 217 of the container thread 215 when the closure 211 is in the sealed and locked position.

The projection 217 and the indentation 226 are disposed along their respective threads so that when the closure 211 is axially drawn into the sealing position on the open end 214 of the container 213 the shoulder 218 of the container thread 215 and the locking shoulder 227 of the closure thread 224 are aligned for locking inter-engagement.

The operation of the closure 211 as shown in FIGS. 9–12 is similar to the operation of the closures in FIGS. 1–8. Referring more specifically to FIG. 10, the closure 211 is drawn into sealing engagement with the open end 214 by the camming action of the lower face 216 of the container thread 215 against the upper face 225 of the closure thread 224 responsive to the rotation of the closure in a clockwise direction. As the closure 211 is drawn downwardly on the neck 212 the resilient sealing member 223 is placed under compression.

As the start end of the closure thread 224 contacts the camming surface 220 of the projection 217, the resilient sealing member 223 is further compressed by the axial downward movement of the closure. Further rotation of the closure 211 causes the projection 217 and the indentation 226 to come into alignment and the closure is urged axially upwardly by the compressed sealing member 223. As is more specifically shown in FIG. 11, the upper face 226 of the closure thread 224 and the lower face 216 of the container thread 215 are in contact with each other and the projection 217 is received in the indentation 226. The shoulder 218 of the projection 217 and the locking shoulder 227 of the closure thread 224 are interengaged to prevent reverse rotation of the closure thereby providing the safety locking feature.

Removal of the closure is illustrated in FIG. 12 wherein downward pressure on the top 221 of the closure 211 forces the closure to move axially downwardly on the neck 212 of the container 213 moving the shoulder 218 and the locking shoulder 227 out of interengagement thereby permitting the closure 211 to be rotated in a counterclockwise direction for removal thereof from the container 213.

Although as described and illustrated in FIGS. 5–12, the thread of the closure and container are shown as having a single cooperating locking means, it is within the scope of the present invention to provide a second cooperating locking means disposed along the threads on the side of the closure and container opposite the illustrated locking means. In this manner the relative size of projections and indentations can be reduced to maximize the shear strength of the locking means while maintaining locking efficiency. In all respects the design and function of the second cooperating locking means is as described above.

It should be noted because of the nature and location of the locking means shown in FIGS. 5–12, that the closures are most advantageously formed by injection molding of a suitable plastic material such as polyvinylchloride or polyethylene and that a conventional collapsible core mold be employed be utilized using injection molding techniques well known in the art. In this manner additional manufacturing steps required to form the cooperating locking means on the thread of the closure are avoided. The closure can be thus efficiently and economically manufactured.

From the foregoing it can be seen that the closure of the present invention is adapted to provide the safety lock feature and fluid tight seal for a container. In accordance with the design of the closure of the present invention, the locking means on the closure, which cooperates with the locking means on the container thread, is integrally formed as a part of the thread of the closure. The safety locking feature is achieved with simplicity of design without any loss of reliability of sealing or manufacturing efficiency.

I claim:

1. The combination of:

a container including a cylindrical neck having an open end;

a closure for said container having a top overlying said open end and a depending cylindrical skirt surrounding a portion of said neck adjacent said open end;

resilient sealing means carried by said closure and disposed between said top and said open end for sealing said open end;

continuous thread means carried on the exterior of said neck and defining a lower surface, and continuous thread means carried on the interior of said cylindrical skirt portion defining a start end and an upper surface, said thread means being adapted for engagement upon rotation of said closure to axially draw said closure into sealing relation with said resilient sealing means compressed between said open end and said closure; and cooperating locking means carried by said continuous thread means for inter-engagement when said closure is in sealing relation with said open end, said locking means including;

a projection carried by one of said thread means and forming an integral part thereof and a corresponding cut out portion disposed on the other of said thread means, said projection and cut out portion being disposed on the respective surfaces of said thread means for registration when said closure is drawn into sealing relation with said open end, said projection being received in said cut out portion by the longitudinally upward movement of said closure responsive to the urging of said resilient sealing means whereby said upper and lower surfaces of said thread means are substantially contiguous and said thread means are locked together, and responsive to a longitudinally downward movement of said closure, said projection is moved out of said cut out portion to unlock said threads for removal of said closure from said container.

2. The combination of claim 1 wherein said cooperating locking means comprises:

at least one upwardly extending projection integrally formed on said thread means of said closure and a corresponding cut out portion on said thread means of said container;

said projection defining a shoulder, said shoulder being disposed on a side of said projection facing away from the start end of said thread means, said portion defining a corresponding shoulder on said thread means of said container;

said projection and said cut out portion being disposed along their respective thread means for mating registration of said projection in said cut out portion and for the inter-engagement of the respective shoulders of said projection and said cut out portion when said closure is axially drawn into sealing relation with said open end of said container.

3. The combination of claim 1 wherein said projection further defines a camming surface disposed on a side of said projection facing toward the start end of said thread means of said closure.

4. The combination of claim 1 wherein said cooperating locking means comprises:

at least one projection extending downwardly from said thread means on said neck and a corresponding indentation disposed on said thread means of said closure, said projection and said identation each provided with a face defining a shoulder extending substantially perpendicularly to the longitudinal axis of their respective threads, said projection and said indentation being disposed along their respective thread for mating registration of said projection in said indentation and for inter-engagement of said shoulders when said closure is drawn into sealing relation with said open end of said container.

5. A safety closure for use in combination with a container including an open-ended neck portion, a thread having a lower surface disposed about said neck portion, said thread having a cut out portion disposed on said lower surface, said closure comprising:

a top defining an outer face and an inner face, a depending cylindrical skirt portion, and a resilient sealing member on said inner face of said top;

a continuous, axially extending thread defining an upper face and a start end portion, said thread being disposed on the interior surface of said depending skirt portion for cooperation with said container thread to axially draw said closure into sealing engagement with said open end of said container whereby said resilient sealing member is compressed between said open end of said container and said inner face of said closure top;

said thread including an upwardly extending projection disposed on the upper surface thereof, said projection having a shoulder defined by a substantially perpendicularly extending face disposed on a side of said projection opposite to said start end of said thread, said projection being disposed on said thread for mating registration in said cut out portion of said container thread by the axial upward movement of said closure on said neck portion responsive to the urging of said compressed sealing member when said closure is drawn into sealing relations on said container.

6. A safety closure for use in combination with a container including an open-ended neck portion, a thread having a lower surface disposed about said neck portion, said container thread having a downwardly extending projection disposed on said lower surface, said closure comprising:

a top portion defining an inner face, a depending cylindrical skirt portion, and a resilient sealing member disposed on said inner face of said top portion;

a continuous, axially extending thread disposed on the interior surface of said depending skirt portion for operation with said container thread to axially draw said closure into sealing engagement with said open end of said container thereby compressing said resilient sealing member between said open end of said container and said inner face of said closure top, said thread having an upper face and a start end;

said thread having an indentation disposed in said upper surface thereof, said indentation being disposed along said thread for alignment with said projection of said container thread when said closure is in sealing relation on said container and for receiving said projection responsive to the upward axial movement of said closure on said container responsive to the urging of said compressed sealing member.

* * * * *

UNITED STATES PATENT AND TRADEMARK OFFICE

CERTIFICATE OF CORRECTION

PATENT NO. : 3,952,899

DATED : April 27, 1976

INVENTOR(S) : Carl W. Cooke

It is certified that error appears in the above-identified patent and that said Letters Patent are hereby corrected as shown below:

Column 1, line 48, "or", first occurrence should read -- of --.

Column 2, line 63, "porition" should be -- portion --;

Column 3, line 11, delete "the", second occurrence.

Column 3, line 47, "comming" should be -- camming --;

Column 4, line 55, "defomed" should be -- deformed --;

Column 5, line 53, after "open" insert -- end --.

Signed and Sealed this

Seventh Day of September 1976

[SEAL]

*Attest:*

RUTH C. MASON
*Attesting Officer*

C. MARSHALL DANN
*Commissioner of Patents and Trademarks*